US008893520B2

(12) United States Patent
Heinbokel et al.

(10) Patent No.: US 8,893,520 B2
(45) Date of Patent: Nov. 25, 2014

(54) $CO_2$-REFRIGERATION DEVICE WITH HEAT RECLAIM

(75) Inventors: Bernd Heinbokel, Cologne (DE); Siegfried Haaf, Cologne (DE); Neelkanth S. Gupte, Katy, TX (US); Ulf J. Jonsson, South Windsor, CT (US); Tobias H. Sienel, Wiesbaden (DE)

(73) Assignee: Carrier Corporation, Farmington, CT (US)

( * ) Notice: Subject to any disclaimer, the term of this patent is extended or adjusted under 35 U.S.C. 154(b) by 540 days.

(21) Appl. No.: 12/971,127

(22) Filed: Dec. 17, 2010

(65) Prior Publication Data

US 2011/0314843 A1 Dec. 29, 2011

Related U.S. Application Data

(63) Continuation of application No. 11/816,337, filed as application No. PCT/EP2005/001727 on Feb. 18, 2005, now abandoned.

(51) Int. Cl.

| | |
|---|---|
| ***F25B 29/00*** | (2006.01) |
| ***F25B 9/00*** | (2006.01) |
| ***F25B 1/10*** | (2006.01) |
| *F25D 21/10* | (2006.01) |
| *F25D 21/12* | (2006.01) |

(52) U.S. Cl.

CPC . *F25B 1/10* (2013.01); *F25B 9/008* (2013.01); *F25B 2339/047* (2013.01); *F25D 21/10* (2013.01); *F25B 2400/22* (2013.01); *F25B 29/003* (2013.01); *F25B 2309/061* (2013.01); *F25D 21/12* (2013.01); *F25B 29/00* (2013.01); *F25B 2400/075* (2013.01)

USPC ..... 62/79

(58) Field of Classification Search

CPC ..... F25B 29/003; F25B 2339/047; F25B 2400/22; F25D 21/00; F25D 21/12

USPC ..... 62/79, 115, 196.4, 238.6

See application file for complete search history.

(56) References Cited

U.S. PATENT DOCUMENTS

| | | | |
|---|---|---|---|
| 2,166,158 | A | 7/1939 | Kalischer |
| 2,537,314 | A | 1/1951 | Mortensen |

(Continued)

FOREIGN PATENT DOCUMENTS

| | | |
|---|---|---|
| CH | 146211 | 4/1931 |
| CH | 225518 A | 2/1943 |

(Continued)

OTHER PUBLICATIONS

Schiesaro P. et al: "Development of a Two Stage CO2 Supermarket System", IIR Conference, New Technologies in Commercial Refrigeration, Jul. 22, 2002, pp. 1-10, Urbana, IL, USA. (XP001169091).

(Continued)

*Primary Examiner* — Frantz Jules
*Assistant Examiner* — Emmanuel Duke
(74) *Attorney, Agent, or Firm* — Carlson, Gaskey & Olds, P.C.

(57) ABSTRACT

A refrigeration device containing $CO_2$ a refrigerant to be circulated, including a compressor, a heat-rejecting heat exchanger, an expansion, and an evaporator which are connected to one another. The refrigeration device includes a first portion and a second portion, the second portion having a higher temperature relative to the first portion when the refrigeration device is in operation. A heat-reclaim heat exchanger is provided at a given location in the second portion, provided to transfer heat to a fluid for further use as a source of heated fluid.

22 Claims, 5 Drawing Sheets

(56) References Cited

U.S. PATENT DOCUMENTS

| | | | | | |
|---|---|---|---|---|---|
| 3,462,966 | A | | 8/1969 | Reid et al. | |
| 3,675,441 | A | | 7/1972 | Perez | |
| 3,926,008 | A | | 12/1975 | Webber | |
| 4,430,866 | A | * | 2/1984 | Willitts | 62/196.4 |
| 4,437,317 | A | * | 3/1984 | Ibrahim | 62/81 |
| 4,441,902 | A | | 4/1984 | Jardine | |
| 4,474,026 | A | * | 10/1984 | Mochizuki et al. | 62/157 |
| 4,554,795 | A | * | 11/1985 | Ibrahim | 62/175 |
| 4,813,239 | A | * | 3/1989 | Olson | 62/81 |
| 4,966,010 | A | * | 10/1990 | Jaster et al. | 62/179 |
| 5,377,500 | A | | 1/1995 | Yang | |
| 5,400,615 | A | | 3/1995 | Pearson | |
| 5,531,078 | A | * | 7/1996 | Day et al. | 62/199 |
| 6,067,482 | A | * | 5/2000 | Shapiro | 700/286 |
| 6,272,870 | B1 | * | 8/2001 | Schaeffer | 62/205 |
| 6,321,561 | B1 | * | 11/2001 | Maget | 62/498 |
| 6,370,895 | B1 | * | 4/2002 | Sakuma et al. | 62/199 |
| 6,647,735 | B2 | * | 11/2003 | Street et al. | 62/132 |
| 6,668,572 | B1 | | 12/2003 | Seo et al. | |
| 7,216,494 | B2 | * | 5/2007 | Thurman | 62/84 |
| 2002/0000094 | A1 | | 1/2002 | Kuroki et al. | |
| 2003/0140638 | A1 | * | 7/2003 | Arshansky et al. | 62/155 |
| 2004/0020230 | A1 | * | 2/2004 | Kuwabara et al. | 62/238.6 |
| 2004/0144528 | A1 | | 7/2004 | Kunimoto et al. | |
| 2005/0126217 | A1 | | 6/2005 | Park | |
| 2006/0123838 | A1 | | 6/2006 | Yu et al. | |

FOREIGN PATENT DOCUMENTS

| | | | |
|---|---|---|---|
| DE | 683151 | | 10/1939 |
| DE | 102004007932 | A1 | 9/2004 |
| EP | 0908688 | A | 4/1999 |
| EP | 1826510 | A2 | 8/2007 |
| FR | 2488683 | A | 2/1982 |
| GB | 143527 | A | 11/1921 |
| GB | 2453515 | | 4/2009 |
| JP | 10253228 | A | 9/1998 |
| JP | 2001099503 | A | 4/2001 |
| JP | 2004003801 | | 1/2004 |
| JP | 2004085104 | A | 3/2004 |
| JP | 2004100979 | A | 4/2004 |
| JP | 2004156847 | A | 6/2004 |
| JP | 2004184028 | A | 7/2004 |
| JP | 2004218944 | | 8/2004 |
| WO | 99/20958 | | 4/1999 |

OTHER PUBLICATIONS

Rekstad H et al.: Measurement on a Two-Stage Et Technique Du Froid—Refrigeration Science and Technology, Paris, FR, Aug. 29, 2004. (XP000962566).

Rieberer et al.: "CO2 Heat Pumps for Space Heating and Tap Water Heating" International Congress of Refrigeration. Proceedings—Congres International Du Froid. Comptes Rendus, XX, XX, vol. 3, Sep. 19, 1999. (XP000962271).

Gebhardt D et al.; "Entwicklung Einer Transkritischen Zweistufigen Supermarktkaelteanlage Fuer Tief—Und Normalkuehlung (2) Development of a Supermarket Transcriticial Multistage Refrigerating Plant for Chilling and Freezing", Kalte Und Klimatechnik, Gentner, Stuttgart, DE, vol. 56, Oct. 2003, pp. 54-65. (XP008028730).

Stene et al.; "Residential CO2 Heat Pump System for Combined Space Heating and Hot Water Heating", International Journal of Refrigeration, Elsevier, Paris, FR, vol. 28, No. 8, Dec. 1, 2005, pp. 1259-1265, (XP025278279).

Stene, J.; "Residential CO2 Heat Pump System for Combined Space Heating and Hot Water Heating", Science Et Technique Du Froid—Refrigeration Science and Technology, Paris, FR, Aug. 29, 2004, (XP000962560).

International Search Report and Written Opinion mailed Dec. 13, 2005 for PCT Application No. PCT/EP2005/001727.

* cited by examiner

$CO_2$-REFRIGERATION DEVICE WITH HEAT RECLAIM

CROSS-REFERENCE TO RELATED APPLICATIONS

This application is a continuation of U.S. application Ser. No. 11/816,337 filed Apr. 15, 2008, now abandoned which claims priority to PCT Application No. PCT/EP2005/001727 filed Feb. 18, 2005.

FIELD OF THE INVENTION

The present invention relates to a refrigeration device containing $CO_2$ as a refrigerant to be circulated, comprising a compressor, a heat-rejecting heat exchanger, an expansion device, and an evaporator, which are connected to one another, wherein the refrigeration device comprises a first portion and a second portion, the second portion having a higher temperature relative to the first portion when the refrigeration device is in operation.

The invention further relates to a method for operating a refrigeration device.

Refrigeration devices are well known in the art and are used for many purposes, such as refrigeration systems in supermarkets, air conditioning of buildings, and many others. Refrigeration devices are essentially heat transfer machines. Heat is moved from one location to a more convenient location elsewhere. The location from which the heat is removed is cooled, which is often the only purpose of the system. One example of a refrigeration device is a vapor compression system, typically consisting of a compressor, which pressurizes and thereby heats the refrigerant, a heat-rejecting heat exchanger which removes heat from the pressurized refrigerant, an expansion device, which expands the refrigerant thereby cooling it off, and an evaporator which takes up heat from the environment. The heat-rejecting heat exchanger can be a condenser or gas cooler or function as both condenser and gas cooler, depending on operating conditions, and the evaporator can be viewed as a heat-accepting heat exchanger. Such a refrigeration device using a circulating refrigerant can be viewed as a system having a first portion and a second portion, the first portion being between the expansion device and the compressor and the second portion being between the compressor and the expansion device. In operation, the second portion is warm relative to the first portion. When the compressor pressurizes the refrigerant, it is thereby heated and this heat generally is waste heat which escapes unused, e.g. by convection. In supermarkets it is common to install refrigeration devices having multiple refrigeration consumers, e.g. refrigerated display cabinets. Often the components of the system generating waste heat are installed outside (e.g. on the rooftop) so that waste heat can escape.

An article by Mei et al. describes the use of "warm liquid refrigerant for defrosting supermarket refrigerated display cases", 2002, AC-02-7-1, ASHRAE Transactions, p. 669-672. According to this method, warm liquid refrigerant is not directed through an expansion device but directly into an evaporator in need of defrosting. Although this method uses heat generated by the refrigeration system for the purpose of defrosting, it is not suitable for transferring waste heat elsewhere and waste heat escapes unused.

BRIEF SUMMARY OF THE INVENTION

It is an object of the present invention to make waste heat generated by the system available for further use. It is another object of the present invention to render the entire system more efficient by providing improved temperature conditions. In the most general sense the present invention is applicable to any refrigeration device which generates waste heat.

In accordance with an embodiment of the present invention this object is attained by providing a refrigeration device containing a refrigerant to be circulated, comprising: a compressor, a heat-rejecting heat exchanger, an expansion device, and an evaporator which are connected to one another, wherein the refrigeration device comprises a first portion and a second portion, the second portion having a higher temperature relative to the first portion when the refrigeration device is in operation; and a heat-reclaim heat exchanger provided at a given location in the second portion, provided to transfer heat to a fluid for further use as a source of heated fluid.

Another common problem of cooling devices is that depending on the operating conditions, temperature, humidity, etc. the evaporator may form a frost coating and thus needs to be defrosted periodically.

In accordance with an embodiment of the present invention, the refrigeration device comprises a fluid path for directing at least part of the heated fluid to the evaporator for defrosting the evaporator. This can be achieved by providing nozzles for spraying heated fluid directly onto the evaporator or the evaporator coils. The heated fluid can either be drained or circulated back to the heat-reclaim heat exchanger, whichever is more practical. Defrosting can also be achieved by passing the heated fluid in conduits which are in heat exchange relationship with the evaporator.

In accordance with a further embodiment of the invention, the refrigeration device comprises a display cabinet to be refrigerated. These display cabinets can be used in supermarkets to display refrigerated goods. The refrigeration device may also comprise display cabinets which can be chilled to different temperatures depending on demand, time of day and other factors, different display cabinets which are kept at respective different temperatures at the same time, or a combination of both. For example some display cabinets can be chilled to. to 4° C. (i.e. refrigerators) and to others to subfreezing temperatures (i.e. freezers).

In accordance with an embodiment of the invention, the refrigeration device comprises a fluid path for circulating at least part of the heated fluid adjacent to windows of a refrigerated display cabinet for defogging the windows of the display cabinet.

In accordance with an embodiment of the invention, the refrigeration device comprises a fluid path for circulating at least part of the heated fluid to fluid channels provided near a surface of a display cabinet, thereby raising the surface temperature above the dew point of water.

In accordance with an embodiment of the invention, the refrigeration device further comprises a fluid path for directing at least part of the heated fluid to a radiator for space heating.

In accordance with an embodiment of the invention, the heat-reclaim heat exchanger is provided to transfer heat to water and the refrigeration device comprises a fluid path for directing at least part of the water to a location where usable warm water is consumed. Thus the refrigeration device can be used to heat usable water for showers, washing machines, and other locations where usable warm water is commonly consumed.

In accordance with an embodiment of an invention the refrigerant is $CO_2$. In addition to using $CO_2$ as a refrigerant which is preferred, other refrigerants such as fluorinated carbon- or hydrocarbon-compounds may be used. Further, one- or two-component refrigerants may be used.

In a preferred embodiment of the present invention, the evaporator comprises evaporator coils.

In accordance with an embodiment of the present invention, the heat-reclaim heat exchanger is provided at a location selected from the group consisting of a location between the compressor and the heat-rejecting heat exchanger, a location combined with the heat-rejecting heat exchanger, and a location between the heat-rejecting heat exchanger and the expansion device.

According to an embodiment of the invention, the device comprises an intermediate expansion device between the heat-rejecting heat exchanger and the expansion device.

According to another embodiment of the invention, the compressor comprises a multi-stage compression with a first and a second compressor stage. It is preferred that the heat-reclaim heat exchanger is provided at a location between the first and the second compressor stage. Each compressor stage may comprise one compressor or several compressors in parallel.

In accordance with an embodiment of the invention, the fluid, which is to be heated by the heat-reclaim heat exchanger, is selected from the group consisting of water and an anti-freeze liquid. Preferably the anti-freeze liquid may be an anti-freeze such as glycol, glycerol or other suitable anti-freeze or a solution of water and an anti-freeze such as glycol, glycerol or other suitable anti-freeze. It is especially preferred to use an anti-freeze liquid when the refrigerating device is located in an environment where subfreezing temperatures are to be expected.

According to a further embodiment of the invention the refrigeration device further comprises one member of the group of a control valve and a variable speed pump, for controlling the temperature of the fluid exiting the heat-reclaim heat exchanger. Control of the temperature of the heated fluid can be achieved by controlling the rate at which the fluid passes the heat-reclaim heat exchanger. Furthermore, it is preferred that the refrigeration device comprises a storage tank for storing the heated fluid. The storage tank may be provided with further conduits. In the case where usable water is used as a fluid, the tank may be provided with a conduit to a location where usable warm water is used. Fluid to be heated during periods when the refrigeration device is in use and stored for later use when demand for heated fluid is high. For example, during day time operation, when outside temperatures are high, increased refrigeration or air conditioning may be required. During this period, fluid can be heated and stored. During night time operation, no or only moderate refrigeration or air conditioning is required, but space heating or usable warm water may be required. During this period the stored heated fluid (e.g. usable warm water) can be used.

Further the device may comprise a circuit for circulating the fluid, such that the heat-reclaim heat exchanger is part of the circuit for circulating the fluid. The circuit may comprise means for controlling the temperature of the heated fluid, a valve for removing heated liquid from the circuit, a valve for permitting unheated fluid from a fluid source into the circuit, etc.

The invention further relates to a method for operating a refrigeration device comprising the steps of circulating $CO_2$ as a refrigerant through a compressor, a heat-rejecting heat exchanger, an expansion device, and an evaporator, which are connected to one another, wherein the refrigerant circulates through a first portion and a second portion, the second portion having a higher temperature relative to the first portion. An embodiment of the invention comprises the step of transferring heat from a heat-reclaim heat exchanger to a fluid, said heat-reclaim heat exchanger being provided at a given location in a second portion of the refrigeration device. The heated fluid is available for further utilization within or outside of the refrigeration device.

According to an embodiment of the invention, the method further comprises the step of directing at least part of the heated fluid to the evaporator to defrosting the evaporator.

According to another embodiment of the invention, the method comprises the further step of directing at least part of the heated fluid to a radiator for space heating.

According to yet another embodiment of the invention, the method comprises the further step of directing at least part of the heated fluid adjacent to the windows of a refrigerated display cabinet for defogging windows of the display cabinet.

According to a further embodiment of the invention, the fluid may be usable water and the method further comprises the step of directing at least part of the heated water to a location where usable warm water is consumed.

It is to be understood that each of the embodiments and aspects of the invention described above may be used in combination with one or a plurality of other embodiments or aspects of the present invention.

The refrigeration device of this invention may be provided as a heat pump. The technical elements of cooling apparatus and heat pumps are the same. With the cooling apparatus, the purpose of cooling is the primary purpose, and the related generation of heat is normally a side effect. With heat pumps, the generation of heat is the desired purpose, whereas the related cooling effect of the evaporator(s) is normally considered a less useful side effect. This invention also discloses a heat pump having a circuit as disclosed in the present application. Sometimes it is preferred to use the term working fluid rather than to use the term refrigerant when describing a heat pump.

It is emphasized that a combined refrigeration and heating device may be designed in accordance with the teaching of the invention.

A refrigeration circuit containing $CO_2$ as a refrigerant may be a circuit operated in transcritical cycle, or may be a circuit operated in subcritical cycle, or may be a circuit operable in transcritical cycle or in subcritical cycle depending on parameters such as environmental temperature and pressure level after the compressor device. In typical applications such as cooling temperature sensitive products, deep-freezing, cooling buildings, the refrigeration circuit typically is at subcritical temperature level at the heat-rejecting heat exchanger in the cool season of the year and at transcritical temperature at the heat-rejecting heat exchanger some time in the warm season of the year. In the latter situation the heat-rejecting heat exchanger operates as a gas cooler. In case of a subcritical cycle, the heat-rejecting heat exchanger operates as a combined gas cooler and condenser.

The main functions of the accumulator are to permanently keep available a sufficient quantity of liquid refrigerant and to provide a separation between liquid refrigerant and gaseous refrigerant (vapour). In case of transcritical cycle, the expansion of the refrigerant by the expansion device creates a two-phase mixture which is then separated into liquid and vapour in the accumulator.

The refrigeration device/heat pump of this invention has a number of preferred fields of application. The most important are cooling food and beverages in shops, restaurants or other locations of storage; cooling other temperature-sensitive products such as pharmaceuticals; deep-freezing; cooling buildings of any sort; cooling cars and any other type of vehicles in the broad sense, such as aircrafts, ships, railway cars etc.

A particularly preferred location for the heat/reclaim heat exchanger is at the heat-rejecting heat exchanger, i.e. the combined effect of removing heat from the $CO_2$ and making use thereof for heating a fluid for further use.

A first preferred form of such combined heat exchanger is designing the heat-rejecting heat exchanger in its totality as a heat exchanger against the fluid. Such a combined heat exchanger may be used for both the subcritical cycle and transcritical cycle.

A second preferred form of such combined heat exchanger is a design wherein only portions of the heat-rejection heat exchanger are used to transfer heat to the fluid. Such design is possible for both the subcritical cycle and transcritical cycle. In the subcritical cycle, the $CO_2$ can be in three phases, namely superheated vapour, two-phase, and subcooled liquid.

The heat-rejection heat exchanger may be designed as an air cooled heat-rejection heat exchanger. It is sometimes advantageous to spray water on the air cooled heat-rejection heat exchanger to enhance the heat transfer in the heat-rejection heat exchanger.

In most cases, counterflow heat exchangers are advantageous. This applies to the combined heat exchanger as well.

It is advantageous to control the outlet temperature of the fluid exiting the heat-reclaim heat exchanger, preferably by a control valve or a variable speed pump.

It is advantageous to pass the fluid through a heat exchanger provided at the conduit leaving the heat-rejection heat exchanger, before passing the fluid to a heat exchanger place before the heat-rejection heat exchanger or a combined heat exchanger. It is advantageous to pass fluid, which thereafter is sprayed on the heat-rejection heat exchanger, through a heat exchanger placed after the heat-rejection heat exchanger.

Whereas the refrigeration device/heat pump of this invention preferably is designed for $CO_2$ as the refrigerant, it is possible to design a refrigeration device/heat pump in accordance with the principles disclosed in the present application, in particular the heat-reclaim heat exchanger, for a different refrigerant as an alternative. This is part of the teaching of this invention.

In most cases the fluid to be heated in the heat-reclaim heat exchanger is a liquid, but it is possible, as an alternative, to design the refrigeration device/heat pump as comprising a heat-reclaim heat exchanger to transfer heat to a gas such as air.

Exemplary embodiments of the present invention are described in greater detail below with reference to the Figures wherein:

DETAILED DESCRIPTION OF THE INVENTION

Figure 1:
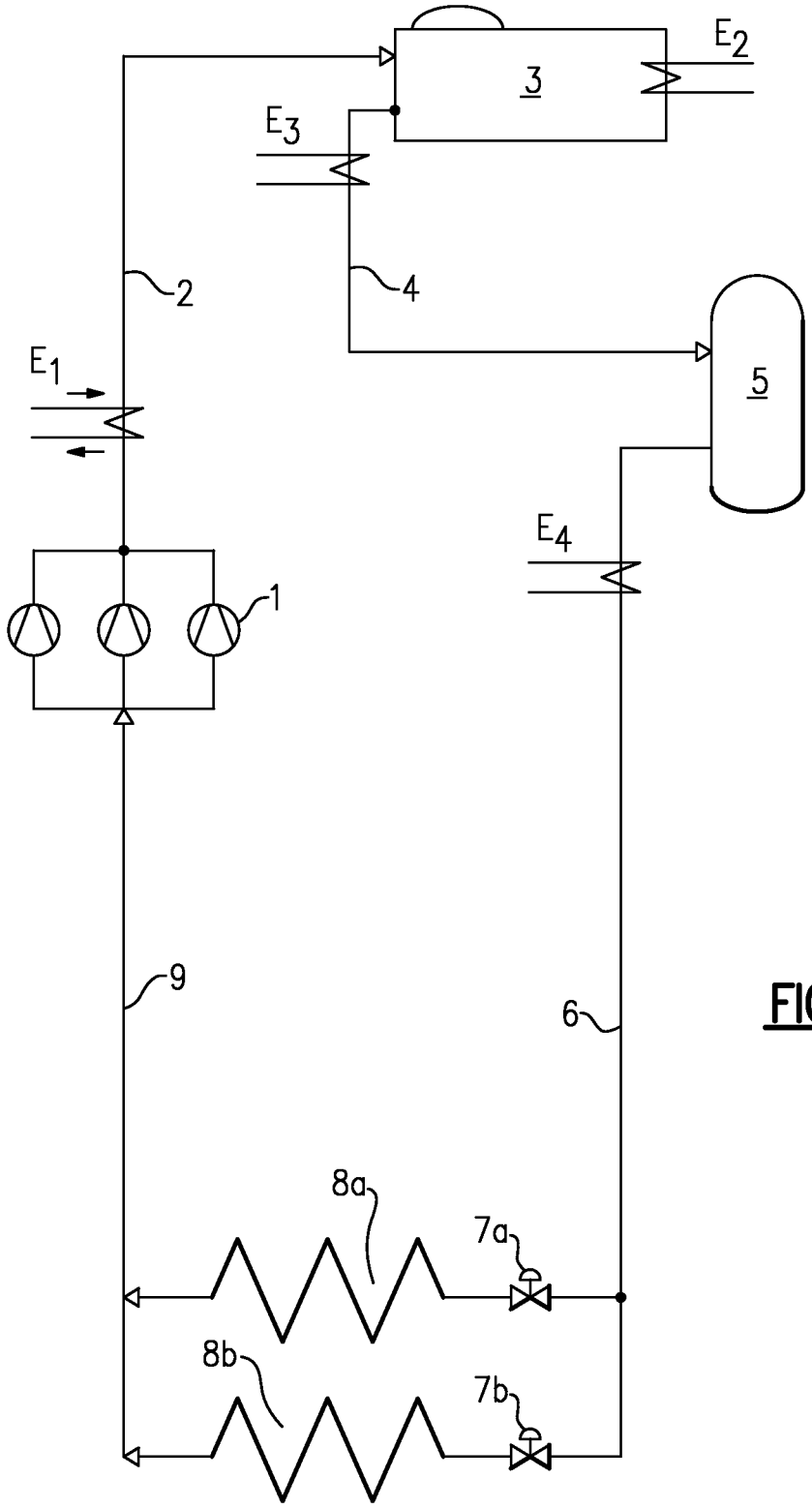
FIG. 1 schematically illustrates a refrigeration device according to a first embodiment of the invention.

Referring to FIG. 1, there is shown a refrigeration device having one compressor or a group of three parallel compressors 1 in which a refrigerant such as $CO_2$ is compressed. As the refrigerant is compressed, it heats up. Via a conduit 2 it is directed to a heat-rejecting heat exchanger 3. In the heat-rejecting heat exchanger 3 the heated, pressurized refrigerant cools off. Under subcritical conditions the $CO_2$ is liquified in the compressor. The liquid refrigerant is directed via the conduit 4 to an accumulator 5, which collects and stores the refrigerant for subsequent delivery via the conduit 6 to one or a plurality of expansion devices 7*a*, 7*b* of one or a plurality of refrigeration consumers. The refrigeration consumers may be refrigerated display cabinets in a supermarket. The expansion devices 7*a*, 7*b* connect to evaporators 8*a* and 8*b*, respectively. The expansion devices may be expansion valves, throttles, capillary expansion devices or other suitable expansion devices. The liquid refrigerant is expanded in the expansion devices 7*a*, 7*b* and changes to the gaseous condition while providing cooling in the respective evaporators 8*a*, 8*b*. The gaseous refrigerant then circulates through the suction line 9 back to the compressor 1. In operation the refrigerant can be viewed as passing through a first portion of the device comprising the evaporators 8*a*, 8*b*, and the suction line 9. In this first portion the refrigerant is of relatively low pressure and low temperature. The refrigerant is then compressed and passes through a second portion of the refrigeration device, namely the conduit 2, the heat-rejecting heat exchanger 3, the conduit 4, the accumulator 5, and the conduit 6. In this second portion the refrigerant has a higher temperature relative to the first portion. The reference numerals $E_1$ to $E_4$ indicate preferred locations where the heat-reclaim heat exchanger may be placed according to the invention. It can be placed between the compressor and the heat-rejecting heat exchanger at conduit 2 ($E_1$); combined with or integrated into the heat-rejecting heat exchanger ($E_2$); between the heat-rejecting heat exchanger 3 and the accumulator 5, at the conduit 4 ($E_3$); and/or between the accumulator 5 and the expansion devices 7*a*, 7*b*, at the conduit 6 ($E_4$). It is possible to route the fluid through heat exchanger $E_3$ first and thereafter through heat exchanger $E_1$ or $E_2$. Depending on the waste heat provided by the refrigeration device, the desired heat transfer to the fluid and other considerations, such as the temperature of the surrounding environment of the various components of the refrigeration device, a heat-reclaim heat exchanger or a plurality of heat-reclaim heat exchangers may be placed at any one or any combinations of these locations.

Figure 2:
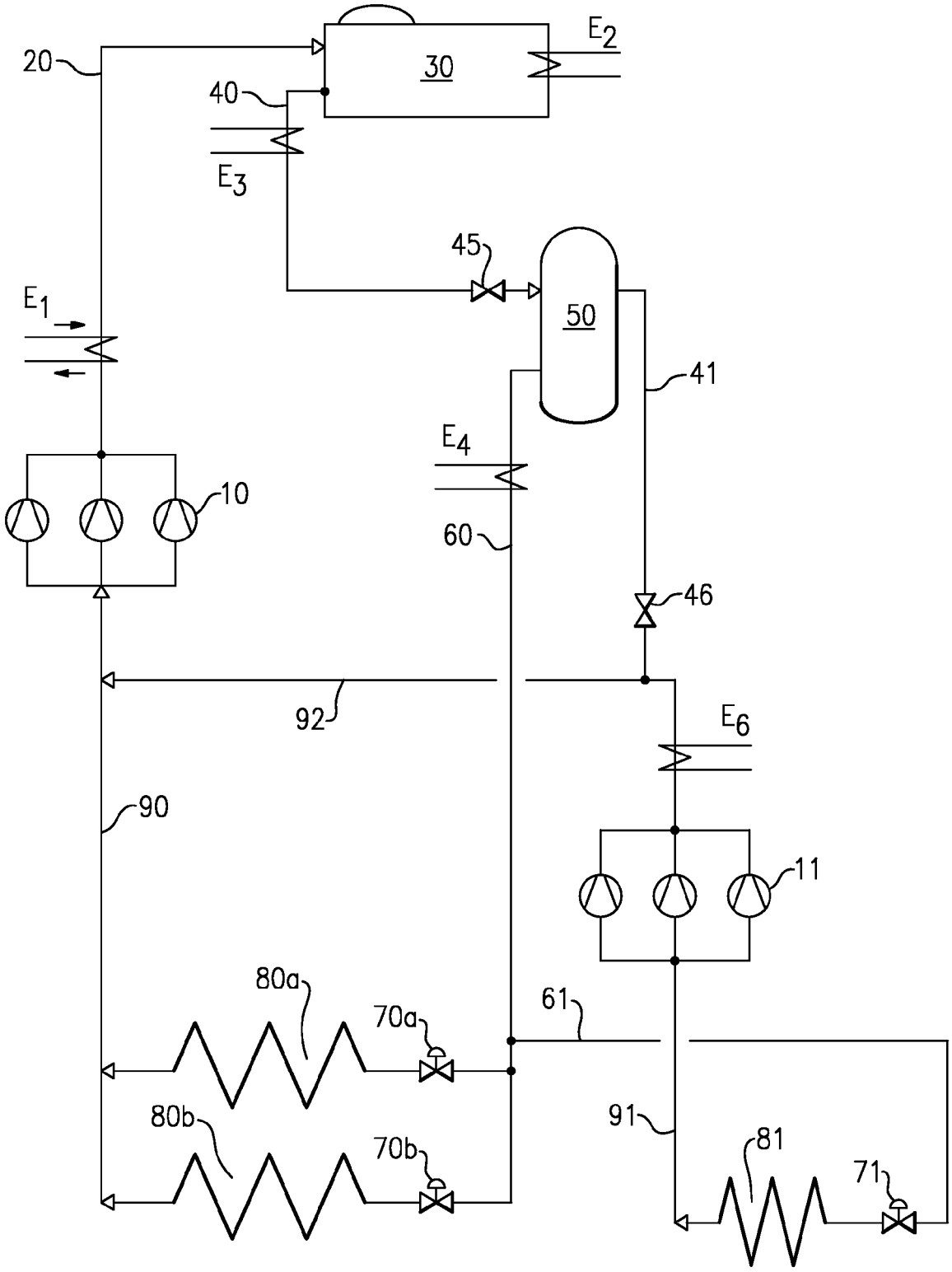
FIG. 2 illustrates a second embodiment of a refrigeration device according to the present invention.

Referring to FIG. 2, there is shown a second embodiment of a refrigeration device according to the present invention. This embodiment comprises a two-stage compression with a first compressor stage 11 and a second compressor stage 10. In the compressor stages refrigerant is compressed and is directed from the second compressor stage via the conduit 20 to the heat-rejecting heat exchanger 30 and from the heat-rejecting heat exchanger 30 via the conduit 40 to the accumulator 50. From there the refrigerant is passed via the conduit 60 to the expansion devices 70*a*, 70*b*. The refrigerant is expanded and passed through the evaporators 80*a*, 80*b*, back to the suction line 90 leading to the second compressor stage 10. Part of the refrigerant passes through the conduit 61 to the expansion device 71, where it is expanded to a lower pressure than the part of the refrigerant expanded in the expansion devices 70*a* and 70*b*. Then that part of the refrigerant passes through the evaporator 81. The system can be designed so that the evaporator 81 is part of a freezer (i.e. refrigeration to subfreezing) while the evaporators 80*a*, 80*b* are used to chill refrigerators to slightly above freezing (e.g. 4° C.). From the evaporator 81 refrigerant is directed via the suction line 91 through the first compressor stage 11, from there through the suction line 92 to the second compressor stage 10.

Between the heat-rejecting heat exchanger 30 and the accumulator 50 there is an intermediate expansion device 45 for an intermediate expansion of the liquified refrigerant into the accumulator 50. In systems using $CO_2$ as refrigerant, during operation at elevated ambient temperatures (i.e. "summer operation") the heat-rejecting heat exchanger may not be able to sufficiently cool the $CO_2$ to obtain liquid $CO_2$. This part of the system is operating under transcritical conditions. By partially expanding the $CO_2$ through the intermediate expansion device 45 it is possible to achieve subcritical conditions and obtain liquid $CO_2$ in the accumulator 50. In this case the accumulator also acts as a separator in which liquid $CO_2$ is separated from gaseous $CO_2$. Also, this allows the components downstream of the intermediate expansion device 45 to be operated at a reduced pressure. The reference signs $E_1$ to $E_7$ indicate preferred locations for placement of a heat-reclaim heat exchanger which can transfer heat to a fluid for further use as a source for heated fluid.

In operation the refrigerant can be viewed as passing through a first portion comprising the evaporators 80*a*, 80*b*, and the suction line 90. In this first portion the refrigerant is of relatively low pressure and low temperature. The refrigerant is then compressed and passes through a second portion of the refrigeration device, namely the conduit(s) 20 exiting the compressor stage 10, the heat-rejecting heat exchanger 30, the conduit 40, the accumulator 50, and the conduit 60. In this second portion the refrigerant has a higher temperature relative to the first portion. Part of the refrigerant is directed through a branch circuit which comprises the conduit 61, expansion device 71, evaporator 81, first compressor stage 11 and suction line 92 leading to the second compressor stage 10. The refrigerant in the branch circuit may be expanded to a lower pressure than in the above mentioned first portion of the refrigeration device to achieve a lower temperature. This branch circuit can be viewed as having a "further first portion" between the expansion device 71 and the first compressor stage 11, and a "further second portion" between the first compressor stage 11 and the second compressor stage 10. In addition to the locations $E_1$ to $E_4$ which have been described in connection with the embodiment of FIG. 1, there is an additional preferred location $E_6$ between the first stage 11 and the second stage 10 of the two-stage compression.

There is a branch line 41 wherein refrigerant from the accumulator 50 can be branched off via a second intermediate expansion device 46 to the suction line 92.

Depending on the waste heat provided by the refrigeration device, the desired heat transfer to the fluid and other considerations, such as the temperature of the surrounding environment of the various components of the refrigeration device, a heat-reclaim heat exchanger or a plurality of heat-reclaim heat exchangers may be placed at any one or any combinations of these locations.

Typical pressures and temperatures are: 50 to 120 bar and 50 to 150° C. (transcritical operation) or 40 to 70 bar (subcritical operation) after compressor 10. 25 to 45° C. (transcritical operation) or 10 to 30° C. (subcritical operation) after heat-rejecting heat exchanger 30. 30 to 40 bar in accumulator 50. Minus 15 to 0° C. and 20 to 35 bar in evaporators 80*a* and 80*b*. Minus 50 to minus 25° C. and 7 to 15 bar in the evaporator 81.

Figure 3:
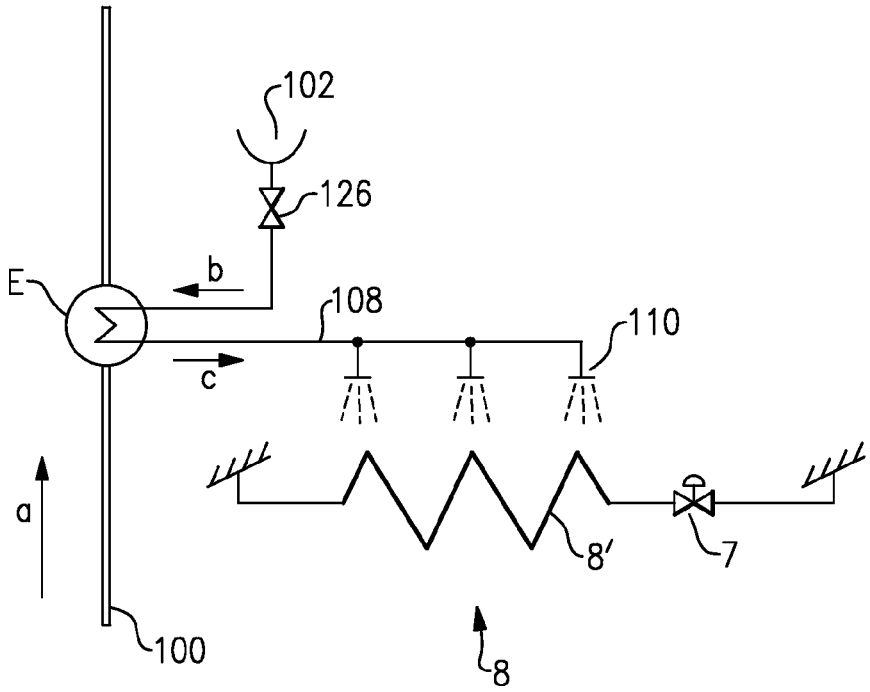
FIG. 3 illustrates a first detail of an embodiment of the invention.

FIG. 3 shows a detail of an embodiment of the present invention. A heat-reclaim heat exchanger E is located at a conduit 100. Warm refrigerant passes through the conduit 100 in direction of the arrow a. The heat-reclaim heat exchanger E in this embodiment and in the embodiments described with reference to the FIGS. 4, 5, 6, 7, and 8 may be a heat-reclaim heat exchanger located at any of the locations $E_1$ to $E_7$ described with reference to FIGS. 1 and 2, respectively. In all the embodiments shown in FIGS. 3 to 7 the flow rate of fluid passing through the heat exchanger may be regulated by a control device 126; 126' which may e.g. be a control valve or variable speed pump. The control of flow may be in a "on/off" fashion or may use flow rates between "completely on" and "off". In the embodiment of the invention depicted in FIG. 3, heated fluid is used to defrost evaporator coils 8' of an evaporator 8. Fluid from a fluid source 102 is passed through a control device 126 and directed in direction of the arrows b, c, in a counter flow direction through the heat-reclaim heat exchanger E and then via a conduit 108 to nozzles 110. Whenever defrosting is necessary, the valve 126 may be opened so as to pass fluid through the heat-reclaim heat exchanger E. The heated fluid is then sprayed via the nozzles 110 over the coils 8' of the evaporator 8 to defrost the evaporator coils. As an alternative, the nozzles 110 may be more closely integrated in the evaporator coils.

Figure 4:
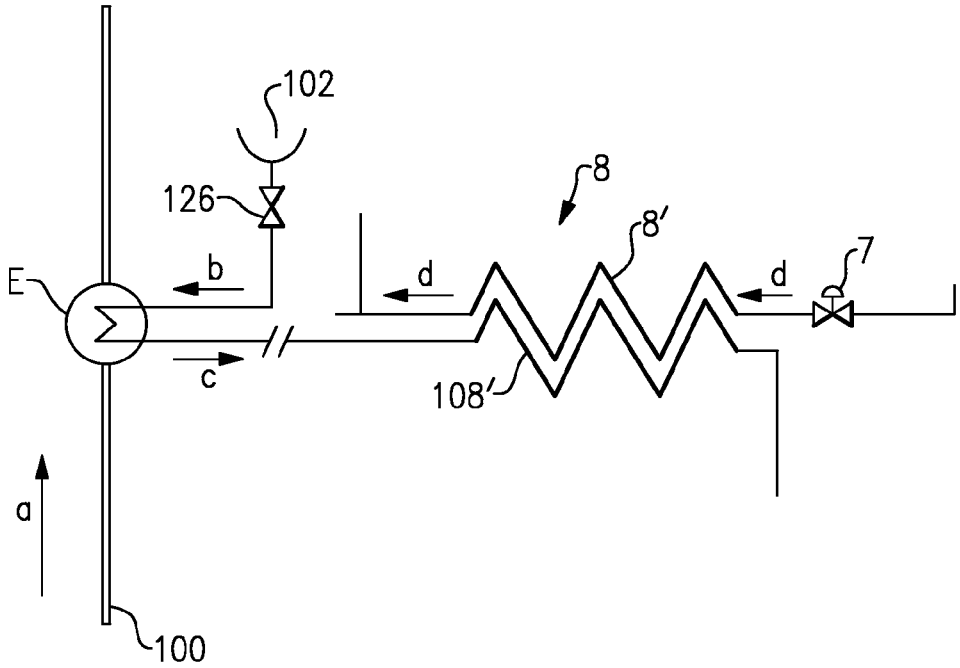
FIG. 4 illustrates a second detail of an embodiment of the invention.

FIG. 4 shows a second alternative embodiment of the invention wherein heated fluid is used to defrost the evaporator coils 8' of an evaporator 8 as refrigerant passes through the expansion device 7 and the evaporator coils 8' in direction of the arrow d, cooling of the evaporator coils 8' may cause a layer of ice to develop on the outside of the evaporator coils 8', thus making a defrost operation necessary. Whenever a defrost operation is necessary, the control valve 126 is opened to permit fluid from a fluid source 102 to be passed in direction of the arrows b, c, through the heat-reclaim heat exchanger E and then via the conduit 108' which is in heat transfer relationship with the evaporator coils 8'. Heat from the heated fluid is thus transferred to the evaporator coils 8' to defrost. In the embodiments of FIGS. 3 and 4 after transferring heat to the evaporator coils 8' to be defrosted, the fluid may either be discharged (drained) or circulated back to the source 102 (not shown).

Figure 5:
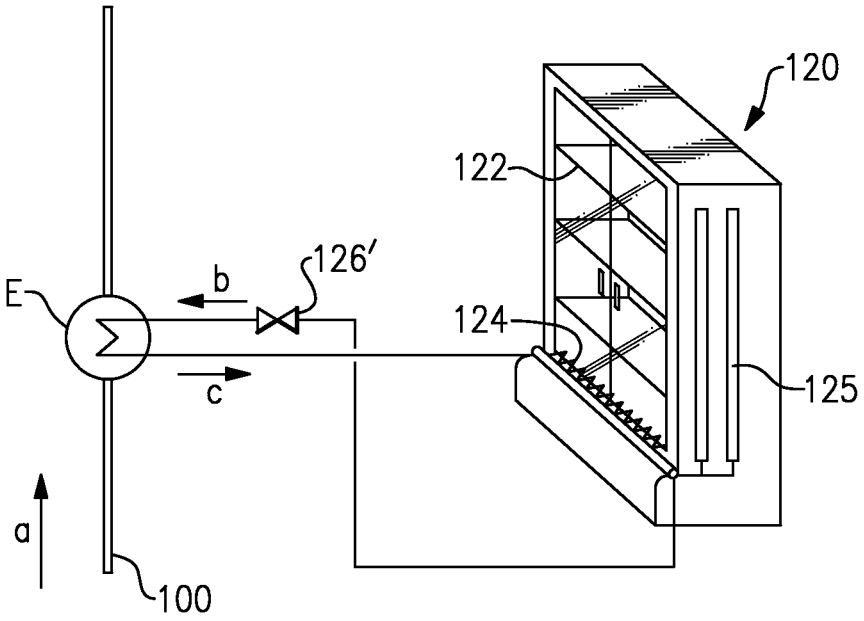
FIG. 5 illustrates a third detail of an embodiment of the invention.

In accordance with an embodiment of the invention shown in FIG. 5, the heated fluid is used to defog the windows 122 of a display cabinet 120. Fluid is passed through the heat-reclaim heat exchanger in counter-flow direction along the direction of the arrows b, c, and is directed to a conduit 124 which is adjacent to the windows 122 of the display cabinet 120. From the conduit 124 the fluid is directed in circulating fashion to a control device 126'. Whenever the windows 122 of the display cabinet 120 are fogged due to condensate formation on the windows 122, the control device 126' permits fluid to flow through the heat-reclaim heat exchanger. The heated fluid then causes defogging of the windows 122 as it flows through the conduit 124 in a manner well-known in the art. Defogging may be assisted by the use of a blower (not shown) to aid in the transfer of heat from the conduit 124 to the windows 122, as is also known in the art. The defogging procedure may be operated continually or periodically, as required.

FIG. 5 also shows a further option how to use the heated fluid. The heated fluid is passed through fluid channels 125 provided in a wall of the display cabinet 120 near to the outer surface of the wall. The heated fluid raises the temperature of such outer wall surface above the dew point of water. The formation of condensed water on that surface ("sweating") is avoided.

Figure 6:
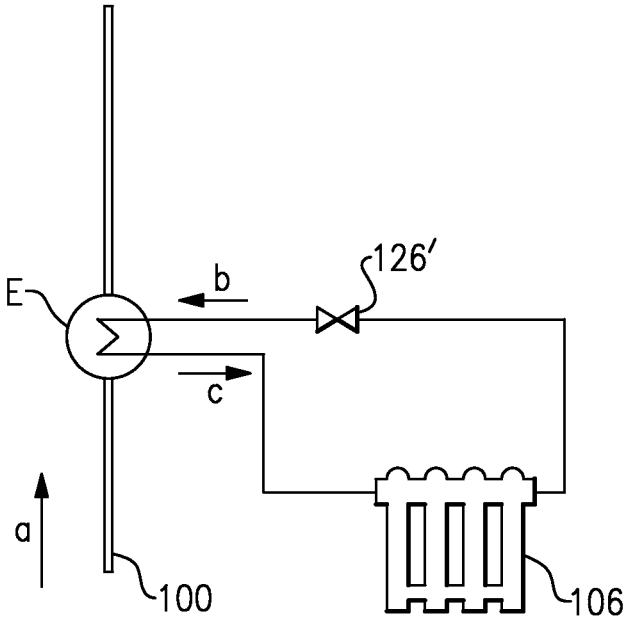
FIG. 6 illustrates a fourth detail of an embodiment of the invention.

Referring to FIG. 6, an embodiment of the invention is shown, wherein the heated fluid is used for space-heating. The heat-reclaim heat exchanger is connected to a radiator 106. The radiator 106 may be placed in a space where the refrigeration device operates or may be placed in a different space where heating is desired. Whenever heating is required, a control device 126' permits fluid to flow through the heat-reclaim heat exchanger E in direction of the arrows b, c. The control device 126' may be connected to a temperature sensor (not shown) for controlling the temperature of the space to be heated, as is known. The heated fluid then passes through the radiator 106 which emits heat in a space to be heated. Although only one radiator 106 is shown, it is understood that a system of a plurality of radiators may be connected to the heat-reclaim heat exchanger. Further, although the radiator 106 is depicted as a standing radiator body, it is understood that the radiator may also be designed as floor heating system or may be of any other known design suitable to transfer heat into a space for space heating.

Figure 7:
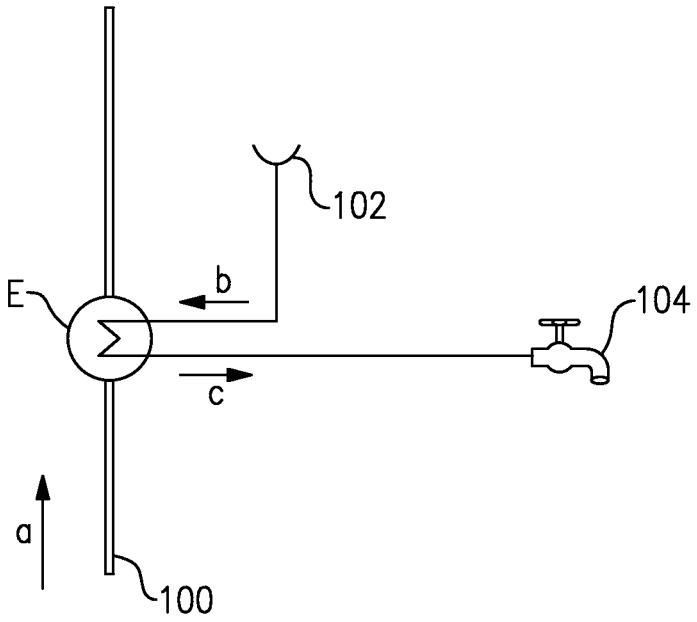
FIG. 7 illustrates a fifth detail of an embodiment of the invention.

Referring to FIG. 7, an embodiment of the invention is shown, wherein usable water is used as a fluid and is directed to a location where usable warm water is consumed. Usable water from a source 102' for usable water can be passed through the heat-reclaim heat exchanger E in direction of the arrows b, c, to a location 104 where heated usable water (usable warm water) is consumed. This location 104 can be a warm water faucet, a shower, a washing machine or other location where warm water is used. A control for controlling the temperature of the usable warm water (not shown) can be incorporated into this embodiment, e.g. means for mixing usable warm water with usable cold water or means for controlling the rate of flow through the heat-reclaim heat exchanger E to achieve a desired temperature of the usable warm water.

Figure 8:
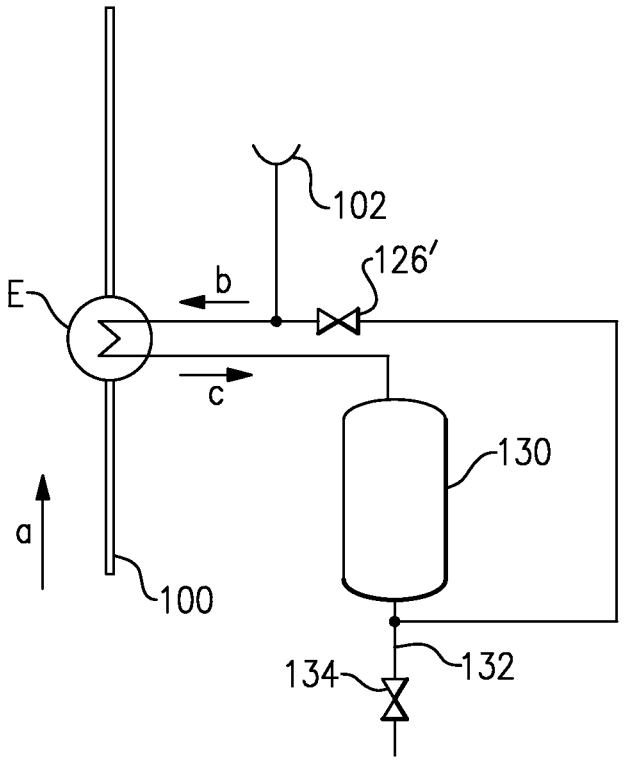
FIG. 8 illustrates a sixth detail of an embodiment of the invention.

Referring to FIG. 8, an embodiment of the invention using a storage tank 130 for heated fluid is shown. Heated fluid is directed in the direction of the arrows b, c through a heat-reclaim heat exchanger E an to a storage tank 130. From this storage tank 130 it is directed to a control 126' for controlling the rate or flow to the heat-reclaim heat exchanger E. The heated fluid is stored in the stored tank 130. When heated fluid is required for further use, heated fluid can be withdrawn via the conduit 132 from the tank 130 by opening the control valve 134. The heated fluid is then available for further use such as described above (e.g. defrosting, defogging, source of usable warm water). Heated fluid that has been withdrawn is replaced from a fluid source 102.

The fluid may be carried in flexible tubes, in particular those manufactured from plastics material. Flexible tubes are easily moved into place, connected and repositioned if necessary. This reduces installation time and cost.

The foregoing description is only exemplary of the principles of the invention. Many modifications and variations are possible in light of the above teachings. It is, therefore, to be understood that within the scope of the appended claims, the invention may be practiced otherwise than using the example embodiments which have been specifically described. For that reason the following claims should be studied to determine the true scope and content of this invention.

What is claimed is:

1. A refrigeration circuit having a mono- or multi-component refrigerant circulating therein, the refrigeration circuit enabling an overcritical operation, the refrigeration circuit, in the direction of flow, comprising: a condenser/gas cooler; an intermediate relief device; a collecting container; a refrigerating relief device connected downstream of the collecting container; an evaporator connected downstream of the refrigerating relief device; and a compressor unit connected to the evaporator by a suction line, wherein gas space of the collecting container is connected or connectable by a connection line to an input of the compressor unit, wherein the connection line joins into the suction line at a position before the compressor unit, wherein the collecting container is further connected to at least one freezing consumer having a freezing relief valve connected between the collecting container and the at least one freezing consumer, and a deep-freeze compressor unit including an inlet side and an outlet side, wherein the inlet side of the deep-freeze compressor is connected to the at least one freezing consumer and the outlet side is connected to the input of the compressor unit, and wherein a heat-reclaim heat exchanger, provided to transfer heat to a fluid for further use, is arranged in at least one of the lines between the compressor unit and the condenser/gas cooler, between the condenser/gas cooler and the intermediate relief device, between the collecting container and the refrigerating relief device, and between the deep-freeze compressor unit and the compressor unit.

2. The refrigeration device as recited in claim 1 wherein at least one of the compressor units is comprised of a multistage compressor with a first compressor stage and a second compressor stage.

3. The refrigeration device as recited in claim 1 further including a display cabinet to be refrigerated.

4. The refrigeration device as recited in claim 1 wherein the evaporator includes evaporator coils.

5. The refrigeration device as recited in claim 1 wherein the fluid is selected from the group consisting of water and an anti-freeze liquid.

6. The refrigeration device as recited in claim 1 further including one member of the group consisting of a control valve and a variable speed pump for controlling a temperature of the heated fluid exiting the heat-reclaim heat exchanger.

7. The refrigeration device as recited in claim 1 further including a storage tank for the heated fluid.

8. The refrigeration device as recited in claim 1 further including a circuit for circulating the fluid.

9. The refrigeration device as recited in claim 1 further including a fluid path for directing at least part of the heated fluid to the evaporator for defrosting the evaporator.

10. The refrigeration device as recited in claim 1 further including at least one member of the group consisting of nozzles for spraying at least part of the heated fluid onto the evaporator coils and conduits for passing at least part of the heated fluid in heat exchange relationship with the evaporator.

11. The refrigeration device as recited in claim 3 further including a fluid path for circulating at least part of the heated fluid adjacent to windows of the display cabinet for defogging the windows.

12. The refrigeration device as recited in claim 3 further including a fluid path for circulating at least part of the heated fluid to fluid channels provided near a surface of the display cabinet, thereby raising a surface temperature above a dew point of water.

13. The refrigeration device as recited in claim 1 further including a fluid path for directing at least part of the heated fluid to a radiator for space heating.

14. The refrigeration device as recited in claim 1 wherein the heat-reclaim heat exchanger is provided to transfer heat to usable water and including a fluid path for directing at least part of the water to a location where usable warm water is consumed.

15. The refrigeration device as recited in claim 1 wherein the refrigerant is carbon dioxide.

16. A method for operating a refrigeration device, the method comprising the steps of: circulating a mono- or multi-component refrigerant in a refrigeration circuit, the refrigeration circuit enabling an overcritical operation and including, in a direction of flow, a condenser/gas cooler, an intermediate relief device, a collecting container, a refrigerating relief device connected downstream of the collecting container, an evaporator connected downstream of the refrigerating relief device, and a compressor unit connected to the evaporator by a suction line, wherein gas space of the collecting container is connected or connectable by a connection line to an input of the compressor unit, wherein a relief valve is provided in the connection line between the gas space of the collecting container and the input of the compressor unit, the connection line joins into the suction line at a position before the compressor unit, the collecting container is further connected to at least one freezing consumer having a freezing relief valve connected between the collecting container and the at least one freezing consumer, and a deep-freeze compressor unit including an inlet side and an outlet side, wherein the inlet side of the deep-freeze compressor is connected to the at least one freezing consumer and the outlet side is connected to the input of the compressor unit; and transferring heat from a heat-reclaim heat exchanger to a fluid, the heat-reclaim heat exchanger being provided in at least one of the lines between the compressor unit and the condenser/gas cooler, between the condenser/gas cooler and the intermediate relief device, between the collecting container and the relief device, and between the deep-freeze compressor unit and the compressor unit.

17. The method for operating a refrigeration device according to claim 16 including the step of directing at least part of the heated fluid to the evaporator for defrosting the evaporator.

18. The method for operating a refrigeration device according to claim 16 including the step of directing at least part of the heated fluid to a radiator for space heating.

19. The method for operating a refrigeration device according to claim 16 including the step of directing at least part of the heated fluid adjacent to windows of a refrigerated display cabinet for defogging the windows.

20. The method for operating a refrigeration device according to claim 16 wherein the fluid is usable water, including the step of directing at least part of the water to a location where usable warm water is consumed.

21. The method according to claim 16 wherein the refrigerant is carbon dioxide.

22. The refrigeration device as recited in claim 1 wherein the evaporator and the at least one freezer consumer are connected in parallel.

* * * * *